US006471601B1

(12) United States Patent
McCabe et al.

(10) Patent No.: US 6,471,601 B1
(45) Date of Patent: Oct. 29, 2002

(54) GOLF CLUB SOLE CONFIGURATION

(75) Inventors: Terrill R. McCabe, Carlsbad; Philamon W. Rodgers, San Diego, both of CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/488,539

(22) Filed: Jan. 21, 2000

(51) Int. Cl.[7] ..... A63B 53/04

(52) U.S. Cl. ..... 473/290; 473/328

(58) Field of Search ..... 473/328, 344, 473/324, 290, 291

(56) References Cited

U.S. PATENT DOCUMENTS

| | | | |
|---|---|---|---|
| 1,128,288 | A | 2/1915 | Churchill |
| 1,505,296 | A | 8/1924 | Smith |
| 1,541,126 | A | 6/1925 | Dunn |
| 1,666,174 | A | 4/1928 | Holland |
| 1,854,548 | A | 4/1932 | Hunt |
| D94,549 | S | 2/1935 | Jansky |
| D94,550 | S | 2/1935 | Jansky |
| 2,041,676 | A | 5/1936 | Gallagher |
| 2,784,969 | A | 3/1957 | Brandon |
| 3,020,048 | A | 2/1962 | Carroll |
| 3,068,011 | A | 12/1962 | Sano |
| 3,079,157 | A | 2/1963 | Turner |
| 3,138,386 | A | 6/1964 | Onions |
| 3,166,320 | A | 1/1965 | Onions |
| 3,655,188 | A | 4/1972 | Solheim |
| 3,810,631 | A | 5/1974 | Braly |
| 3,841,641 | A | 10/1974 | Bennett |
| 3,897,065 | A | 7/1975 | Solheim |
| 3,961,796 | A | 6/1976 | Thompson |
| D240,948 | S | 8/1976 | Redoutey |
| 3,976,299 | A | 8/1976 | Lawrence et al. |
| 3,997,170 | A | 12/1976 | Goldberg |
| 4,000,902 | A | 1/1977 | Perkins |
| D246,541 | S | 11/1977 | Myers |
| 4,322,083 | A | 3/1982 | Imai |
| 4,420,156 | A | * 12/1983 | Campau |
| 4,671,513 | A | 6/1987 | Swanson |
| 4,850,593 | A | 7/1989 | Nelson |
| 4,854,580 | A | 8/1989 | Kobayashi |
| 4,867,457 | A | 9/1989 | Lowe |
| D318,087 | S | 7/1991 | Helmstetter |
| 5,060,949 | A | 10/1991 | Brill |
| 5,154,423 | A | 10/1992 | Antonious |
| D343,434 | S | 1/1994 | Helmstetter et al. |

(List continued on next page.)

FOREIGN PATENT DOCUMENTS

| | | |
|---|---|---|
| GB | 8261 | of 1891 |
| WO | WO 99/38576 | 8/1999 |

OTHER PUBLICATIONS

1931 Professional, p. 4.
1934 Professional, p. 7.
Golf World, May 4, 1971, vol. 24, No. 9, p. 9.
Maltby, Golf Club Design, Fitting, Alteration and Repair The Principles and Procedures, 1990, chapter 45, pp. 431–439.
How to Pick the Right Sand Wedge, Golf Illustrated, Apr. 1992, pp. 77–82.
Chicago Golf 1996 catalog, p. 17.
Dynacraft 1996 Merchandise Catalog, p. 8.
Mastroni Workable Wedges, Senior Golfer, pp. 68–71.

*Primary Examiner*—Stephen Blau
(74) *Attorney, Agent, or Firm*—Swidler Berlin Shereff Friedman, LLP

(57) ABSTRACT

A golf club or set of golf clubs include a sole having four surfaces: a bottom crescent surface, a positive bounce surface, a heel surface and a toe surface. The bottom crescent surface has a generally straight back boundary approximate the trailing edge and a curved front boundary. Moreover, the bottom crescent surface is substantially flat with the ground when the club addressed by the player.

35 Claims, 10 Drawing Sheets

U.S. PATENT DOCUMENTS

| | | | | |
|---|---|---|---|---|
| D344,117 | S | | 2/1994 | Helmstetter et al. |
| 5,301,944 | A | | 4/1994 | Koehler |
| 5,301,945 | A | | 4/1994 | Schmidt et al. |
| 5,326,105 | A | | 7/1994 | Fenton, Jr. |
| D350,176 | S | | 8/1994 | Antonious |
| 5,377,983 | A | | 1/1995 | Fenton |
| D357,044 | S | | 4/1995 | Ackerman |
| D357,290 | S | | 4/1995 | Viollaz et al. |
| 5,423,534 | A | | 6/1995 | Solheim |
| D360,009 | S | | 7/1995 | Grace |
| D362,288 | S | | 9/1995 | McGraw et al. |
| D364,206 | S | | 11/1995 | Schmidt et al. |
| D364,434 | S | | 11/1995 | McGraw et al. |
| 5,464,218 | A | | 11/1995 | Schmidt et al. |
| 5,467,988 | A | | 11/1995 | Henwood |
| D365,130 | S | | 12/1995 | Schmidt et al. |
| D367,094 | S | | 2/1996 | Williams, Jr. |
| 5,501,460 | A | * | 3/1996 | Scheie |
| D371,589 | S | | 7/1996 | Fortini |
| 5,547,188 | A | | 8/1996 | Dumontier et al. |
| 5,549,296 | A | | 8/1996 | Gilbert |
| 5,564,991 | A | | 10/1996 | Hirose |
| D375,535 | S | | 11/1996 | Gorman |
| D375,987 | S | | 11/1996 | Lin |
| D377,818 | S | | 2/1997 | Gray et al. |
| 5,665,009 | A | * | 9/1997 | Sherwood |
| 5,665,012 | A | | 9/1997 | Bunn, III |
| D387,830 | S | | 12/1997 | Gilbert |
| D398,355 | S | | 9/1998 | Chou et al. |
| 5,800,281 | A | | 9/1998 | Gilbert |
| 5,813,919 | A | | 9/1998 | Best et al. |
| 5,830,082 | A | | 11/1998 | White |
| D404,780 | S | | 1/1999 | Long |
| D411,274 | S | | 6/1999 | Renegar |
| 6,093,113 | A | | 7/2000 | Mertens |
| 6,106,410 | A | | 8/2000 | Glod et al. |

* cited by examiner

GOLF CLUB SOLE CONFIGURATION

TECHNICAL FIELD OF THE INVENTION

The present invention relates generally to golf clubs and, more particularly, to the sole of iron-type golf clubs.

BACKGROUND OF THE INVENTION

Iron type golf clubs generally include a front face, a top line and a sole. The front face interfaces with and strikes the golf ball. A plurality of score lines or grooves are positioned on the face to assist in imparting spin. The top line is generally configured to have a particular look to the golfer and to provide weight. The sole of the golf club is particularly important to the golf shot because it contacts and interacts with the ground during the golf shot. The sole of the golf club is of particular importance for wedges, i.e., clubs used for shorter shots. Wedges generally have a loft of between 45° and 60°, but can be greater.

A Prior golf clubs have included a variety of flange or sole configurations. As stated above, the sole interfaces with the ground. Thus, there are many sole configurations to optimize the performance of the club. Typically, the sole of the club is slightly curved such that when the club is placed on the ground, the leading edge is located above the ground and the trailing edge is located above the ground. The curvature toward the front of the club generally provides bounce. Bounce assists in preventing the club from digging into the ground and substantially slow the club head speed. The curvature toward the trailing edge generally prevents the club head from getting caught on the ground during the back swing.

There is typically more bounce built into wedges because of various reasons. First, wedges are generally swung at a steeper incline toward the ground and, therefore, more likely to dig into the ground. Second, wedges generally see different types of ground conditions, including sand, rough and hard pan surfaces. Thus, the sole of the wedge-type golf club is critical to the clubs playability and performance.

The present invention is directed to an improved golf club sole for an iron-type golf club that increases the club's playability. The invention is particularly useful on wedges.

SUMMARY OF THE INVENTION

The present invention is directed to a golf club having a sole that includes a bottom surface that is substantially planar with the ground when addressed by a player. The bottom surface is preferably crescent-shaped with a back border being substantially straight and being adjacent to the trailing edge of the sole and a front border extending toward the leading edge of the club. Preferably, the furthest forward point of the front border is near the middle of the sole between the toe and the heel.

The present invention also comprises a golf club having a sole comprising four (4) surfaces: a positive bounce crescent surface; a bottom crescent surface and heel and toe sole surfaces. The positive bounce crescent surface is a crescent-shaped surface adjacent to the leading edge of the club face or striking surface. The positive bounce crescent surface is a substantially planar surface that is angled from the ground by a positive bounce angle. The positive bounce angle is the angle with the horizontal plane and is preferably between 16° and 30° and, more preferably, between about 10° and 20°. However, the positive bounce angle can be varied based on the player's desires. Generally, it is preferred that this angle increase for the amount of loft in the club, i.e., the greater the angle of the striking face from vertical, the larger the positive bounce angle. However, many players have a particular amount of bounce angle that they prefer. Thus, the bounce angle can be and often is varied to meet a particular players preference. The crescent has two borders; a front border approximate the leading edge of the club face and a rear border separating the crescent surface from the other surfaces. Preferably, the front border is substantially straight and parallel to the leading edge of the club face and the rear border is curved such that the widest point of the crescent surface is near the center of the club between the toe and heel.

The second surface is the bottom crescent surface which is also a substantially flat surface and is substantially planar with the ground when the club is addressed by the golfer. The bottom crescent surface will generally be a flat surface having an angle with the horizontal plane of between −4° and +4° and, more preferably, between −2° and +2° when the shaft is in the vertical plane. The angle with the horizontal plane is most preferably 0°, so that the surface lies flat on the ground to stabilize the club head, but can be varied slightly for particular players needs. The bottom crescent surface is also preferably crescent-shaped. The surface has two borders, a substantially straight back border nearer or at the trailing edge of the club and a curved front border extending toward the front of the club such that the widest point of the crescent is near the center of the club between the toe and heel.

The furthest forward point of the bottom crescent surface and the furthest back point of the positive bounce crescent surface abut or very nearly abut to form the primary point. This primary point is preferably located at a position such that the flat surface is pushed into the ground when the ball is struck. Preferably, this position is vertically below the intersection of the plane that passes through the leading edge and the perpendicular line though the face approximately 0.55 inches from the leading edge. While the leading point can be located to adjust for a particular player's needs, the line perpendicular to the face at 0.55 inches from the leading edge preferably extends through the bottom crescent surface.

The back border of the bottom crescent surface is generally located at the trailing edge of the sole. Preferably, the back border is located at a point on the club such that the line through the back border and perpendicular to the front face extends through the front face more that 0.55 inches from the leading edge. Also, the back border is preferably located more that 0.25 inches from the primary point on the sole and, more preferably, more than 0.3 inches from the primary point.

The present invention is also directed to a set of irons and preferably wedge irons having lofts greater than 45°. In a preferred set, each of the wedges has a primary point that is located very nearly below the intersection of the plane having the leading edge and line perpendicular to the front face that is 0.55 inches from the leading edge. In another preferred set of wedge irons, the back border of each wedge is located at a point that is approximately 0.7 inches perpendicularly from the leading edge. In another preferred set, the leading edge height is constant. In yet another preferred set, the bounce angle is constant.

DESCRIPTION OF THE PRIOR ART

Figure 1:
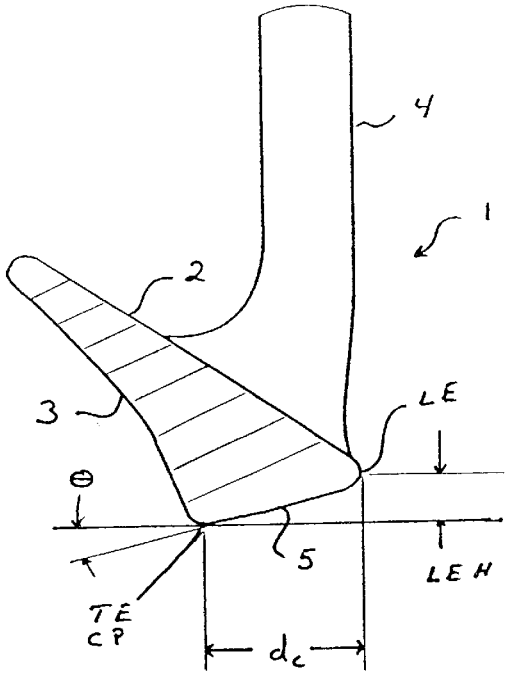
Prior Art FIG. 1
FIG. 1 is a cross-sectional view of a prior art golf club having a substantially flat sole.
Figure 2:
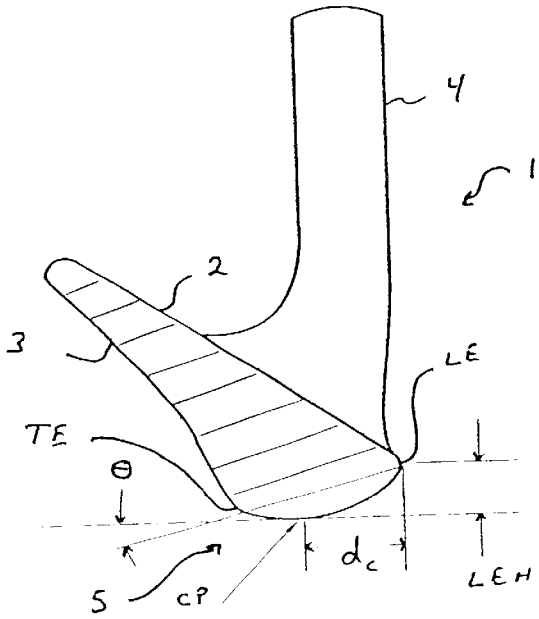
Prior Art FIG. 2
FIG. 2 is a cross-sectional view of a prior art golf club having a substantially rounded sole.
Figure 3:
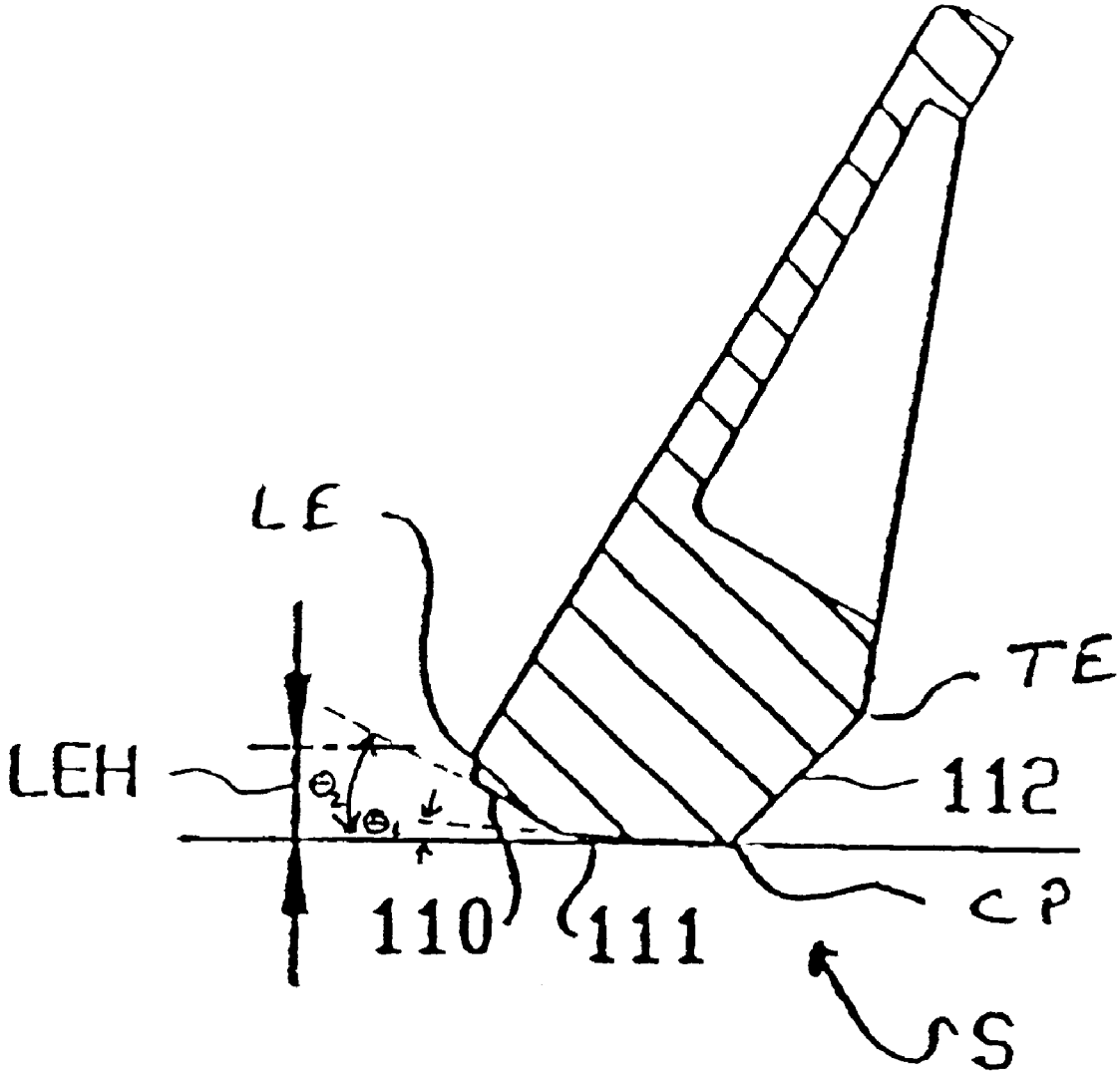
Prior Art FIG. 3
FIG. 3 is a cross-sectional view of a prior art golf club having a substantially flat, crescent-shaped surface.

FIGS. 1–3 represent several prior art sole configurations used particularly on wedges. FIG. 1 discloses a club head 1 having a front face 2, a back face 3, a hosel 4 and a sole 5. In this embodiment, the sole 5 is a substantially flat surface. When the hosel is in the vertical plane as shown here, the sole is angled from the ground or horizontal plane by a bounce angle Θ. The sole 5 has a leading edge LE, a trailing edge TE and a contact point CP. As shown, in this embodiment, the contact point CP is at the trailing edge TE. When the club 1 is addressed, the leading edge LE is above the ground by a leading edge height LEH and the club hits the ground at the contact point PC, which is spaced from the leading edge by a distance $d_c$.

Referring now to FIG. 2, the club head 1 has a front face 2, a back face 3, a hosel 4 and a sole 5. In this embodiment, the sole 5 is a rounded surface. When the hosel is in the vertical plane as shown, the sole 5 is angled from the ground or horizontal plane by a bounce angle Θ. In this embodiment, the leading edge LE is above the ground by about the same leading edge height LEH as the club in FIG. 1, but the contact point CP is much closer to the leading edge LE. That is, the distance dc to the contact point CP is reduced.

FIG. 3 is from U.S. Pat.No. 5,549,296, which is incorporated by reference herein. The sole S has a positive bounce surface 110 near the leading edge LE of the club, a trailing sole surface 112 and a crescent surface 111 between the positive bounce surface 110 and the trailing sole surface 112 adjacent the trailing edge TE. The crescent surface 111 and the positive bounce surface 110 both have positive bounce angles $\Theta_1$, and $\Theta_2$, respectively, such that the leading edge LE is above the ground by a leading edge height LEH. The trailing sole surface 112 has a negative relief angle. Although not evident in this figure, the crescent surface has a generally straight front boundary and a curved rear boundary that forms the contact point CP of the club.

DESCRIPTION OF THE PREFERRED EMBODIMENT

Figure 4:
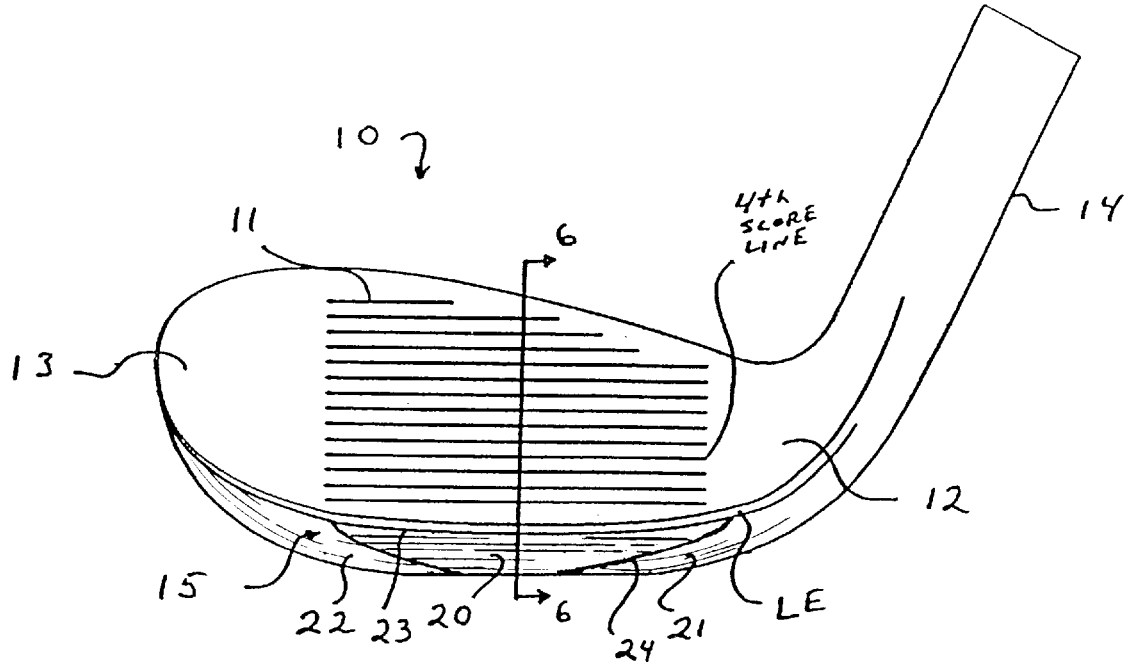
FIG. 4 is a front plan view of a golf club having a sole according to the present invention.
Figure 5:
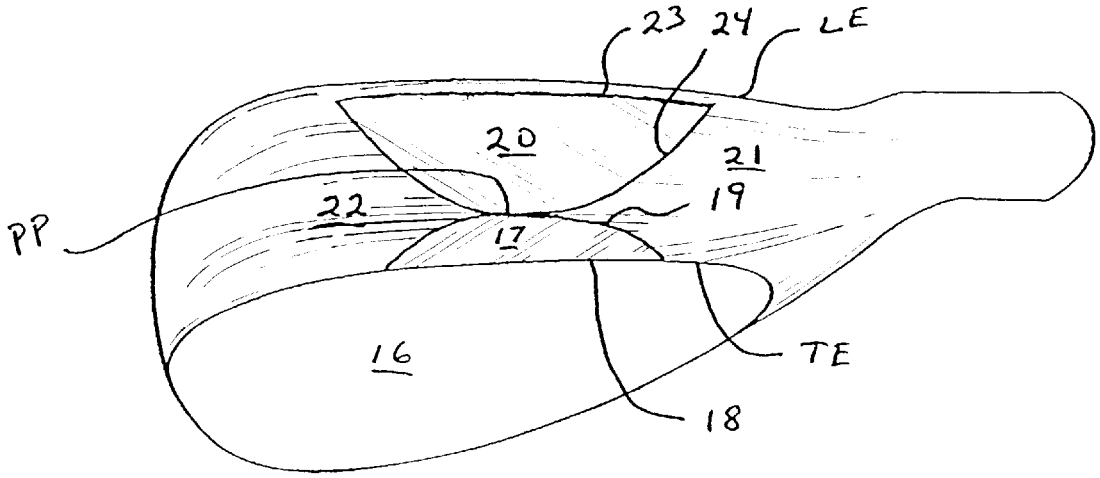
FIG. 5 is a bottom view of the golf club in FIG. 4.
Figure 6:
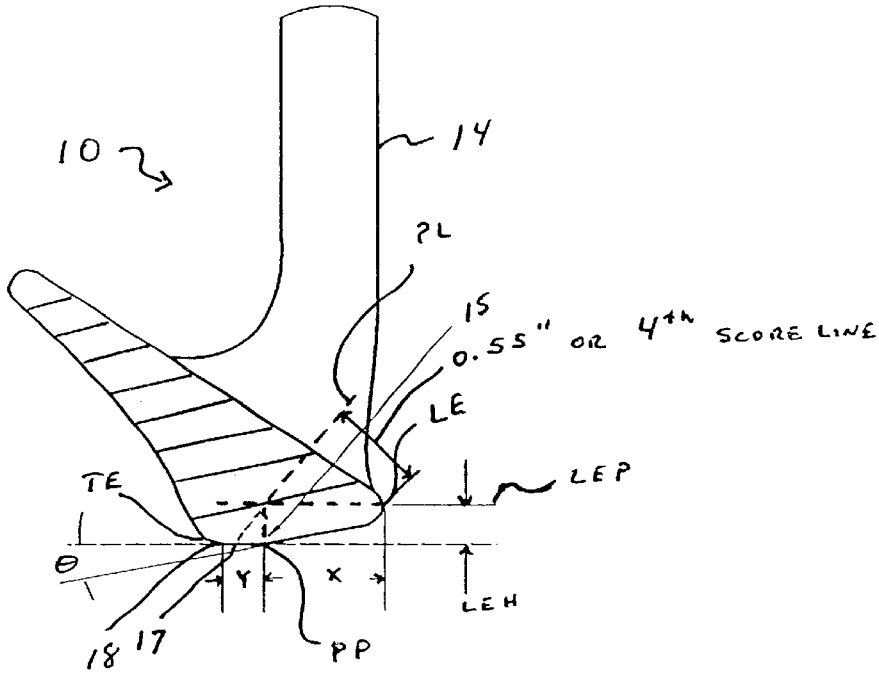
FIG. 6 is a cross-sectional of the golf club in FIG. 4.

Referring to FIGS. 4–6, the present invention is directed to a golf club 10 having front face 11, a heel 12, a toe 13, a hosel 14, a sole 15 and a back face 16. The sole 15 includes a bottom surface 17 that is substantially planar with the ground when addressed by a player. That is, when the player addresses the club to the ball and the hosel is substantially in the vertical plane and at the proper lie angle as shown in FIGS. 6 and 4 respectively, the bottom surface 17 is substantially planar with the ground. For standard clubs, this bottom surface 17 should be substantially planar or flat and approximately or actually perpendicular to a vertical line through the surface. However, for custom clubs, the bottom surface 17 may be angled according to the way a player addresses the ball. Thus, when the hosel 14 is in the vertical plane, the bottom surface 17 is preferably angled between −4° and +4° and, more preferably, between −2° and +2°. Most preferably, the bottom surface 17 is substantially in the horizontal plane when addressed by the player to be flush with the ground.

The bottom surface 17 is preferably crescent-shaped with a back border 18 being substantially straight and being adjacent to the trailing edge TE of the sole and a front border 19 extending toward the leading edge LE of the club 10. Preferably, the furthest forward point, or primary point PP, of the front border 19 is near or substantially in the middle of the sole 15 between the toe 13 and the heel 12.

In the most preferred embodiment of the present invention, the golf club 10 is comprised of a sole comprising four (4) surfaces: a positive bounce crescent surface 20, the bottom crescent surface 17 and heel and toe surfaces 21 and 22 respectively.

The positive bounce crescent surface 20 is a crescent-shaped surface adjacent to the leading edge LE of the club face or striking surface 11. The positive bounce crescent surface 20 is a substantially planar surface or surface with a slight concave or convex curvature from front to back that is angled from the ground by a positive bounce angle Θ. The positive bounce angle is the angle with the horizontal plane or ground and is preferably between 10° and 20°. However, the positive bounce angle Θ can be varied based on the player's desires. Generally, it is preferred that this angle increase for the amount of loft in the club, i.e., the greater the angle of the striking face from vertical, the larger the positive bounce angle. However, many players have a particular amount of bounce angle that they prefer. Thus, the bounce angle Θ can be and often is varied to meet a particular players preference.

The positive bounce crescent surface 20 has a front border 23 that is approximate the leading edge LE of the club face and a rear border 24 separating the positive bounce crescent surface 20 from the other surfaces 17, 21 and 22. Preferably, the front border 23 is substantially straight and approximately parallel with the leading edge LE of the club face and the rear border 24 is curved such that the widest point of the crescent surface is near the center of the club sole 15 between the toe 13 and heel 12.

The furthest forward point, or primary point PP, of the bottom crescent surface 17 and the furthest back point of the positive bounce crescent surface 20 abut or very nearly abut at the primary point PP. This primary point PP is preferably located a distance X from the leading edge LE such that when the ball is impacted the bottom surface is forced into the ground. Preferably, this location is at a position that is vertically below the intersection of the leading edge plane LEP that passes through the leading edge LE and the perpendicular line PL though the face at approximately 0.55 inches from the leading edge LE or at the $4^{th}$ score line. While the primary point PP can be located to adjust for a particular player's needs, the perpendicular line PL to the face at 0.55 from the leading edge inches or at the $4^{th}$ score line preferably extends through the bottom crescent surface 17 for higher lofted clubs. Generally, the distance X is greater than about 0.5 inches and, more preferably, the distance X is between about 0.55 and 0.8 inches.

The back border 18 of the bottom crescent surface 17 is generally located at or very near the trailing edge TE of the sole. Preferably, the back border 18 is located at a point on the club sole 15 such that the line through the back border and perpendicular to the front face extends through the front face more than 0.55 inches from the leading edge or behind the $4^{th}$ score line. Also, the back border 18 is preferably located a distance Y more than about 0.25 inches from the primary point PP on the sole 15 and, more preferably, more than about 0.3 inches from the primary point PP.

The bottom crescent surface 17 and the positive bounce surface 20 also separate the toe surface 22 from the heel surface 21. These surfaces preferably curve upwardly from the center to provide a vertical relief in the heel 12 and toe 13 such that there is little ground pressure away from the bottom crescent surface 17. Such relief means that the ends of the contact area along the front border 19 of the bottom crescent surface 17 are the lowest points of the heel and toe surfaces 21 and 22.

Figure 7:
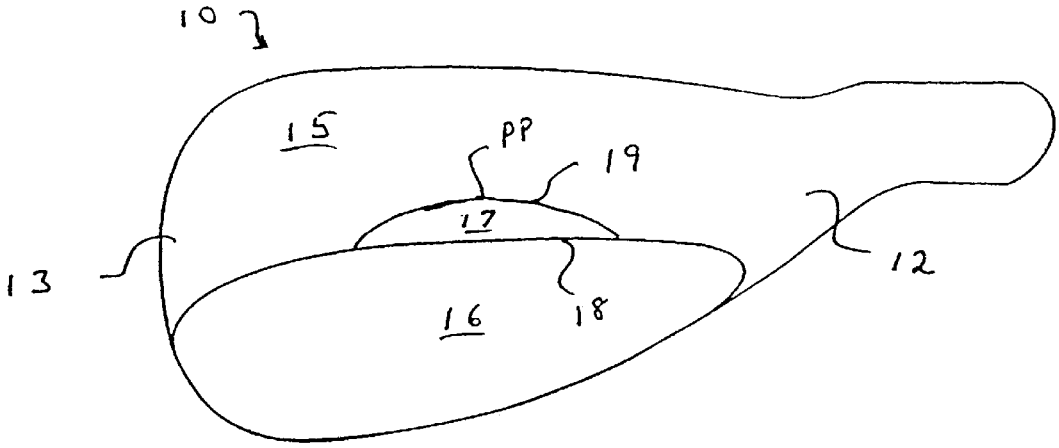
FIG. 7 is a bottom view of a second embodiment of a golf club having a sole according to the present invention.
Figures 8, 9, 10, 11:
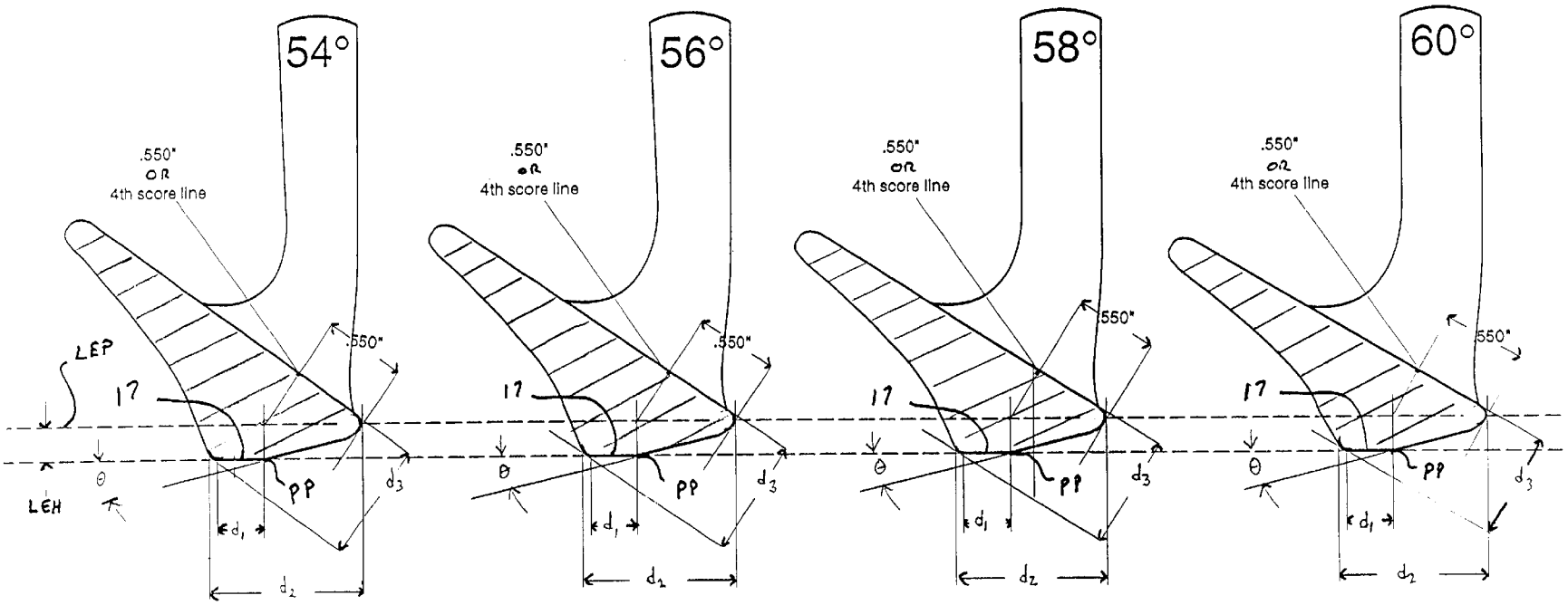
FIG. 8 is cross-sectional view of an embodiment of a golf club having a sole according to the present invention.
FIG. 9 is cross-sectional view of an embodiment of a golf club having a sole according to the present invention.
FIG. 10 is cross-sectional view of an embodiment of a golf club having a sole according to the present invention.
FIG. 11 is cross-sectional view of an embodiment of a golf club having a sole according to the present invention.
Figures 12, 13, 14, 15:
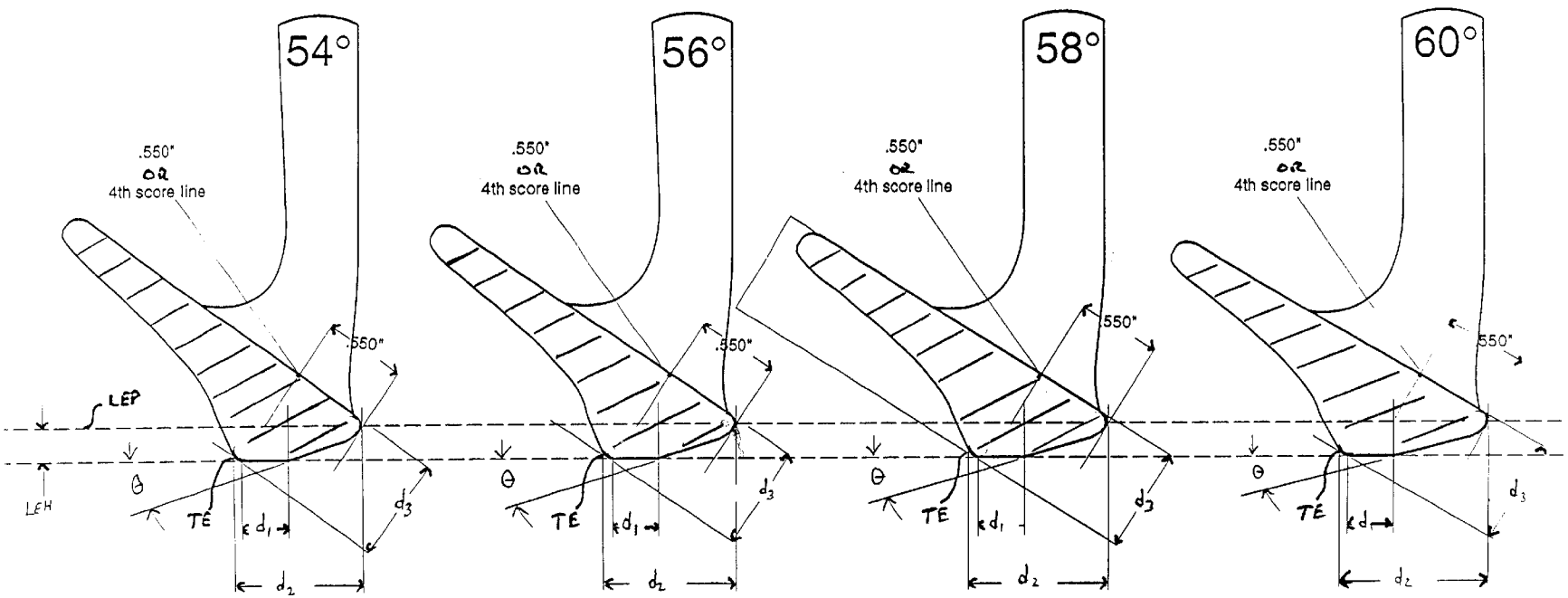
FIG. 12 is cross-sectional view of an embodiment of a golf club having a sole according to the present invention.
FIG. 13 is cross-sectional view of an embodiment of a golf club having a sole according to the present invention.
FIG. 14 is cross-sectional view of an embodiment of a golf club having a sole according to the present invention.
FIG. 15 is cross-sectional view of an embodiment of a golf club having a sole according to the present invention.
Figures 16, 17, 18, 19:
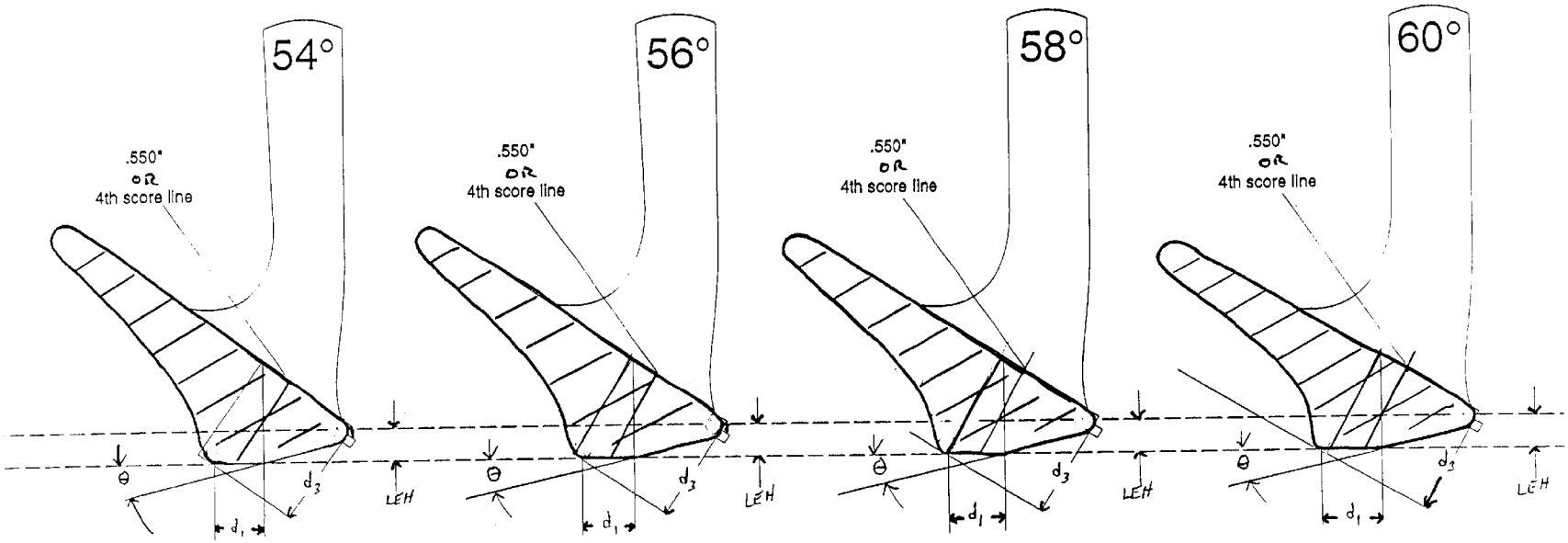
FIG. 16 is a blown up cross-sectional view of a portion of another embodiment of a sole according to the present invention.
FIG. 17 is cross-sectional view of an embodiment of a golf club having a sole according to the present invention.
FIG. 18 is cross-sectional view of an embodiment of a golf club having a sole according to the present invention.
FIG. 19 is a cross-sectional view of an embodiment of a golf club having a sole according to the present invention.
Figures 20, 21, 22, 23:
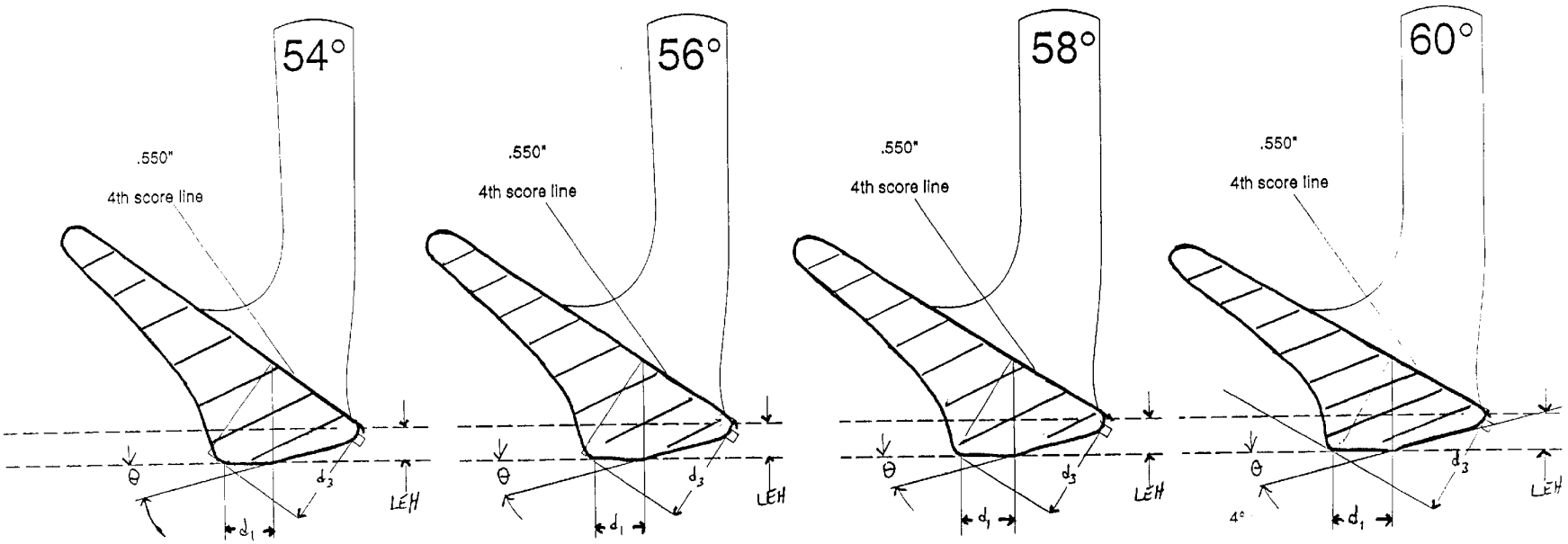
FIG. 20 is cross-sectional view of an embodiment of a golf club having a sole according to the present invention.
FIG. 21 is cross-sectional view of an embodiment of a golf club having a sole according to the present invention.
FIG. 22 is cross-sectional view of an embodiment of a golf club having a sole according to the present invention.
FIG. 23 is cross-sectional view of an embodiment of a golf club having a sole according to the present invention.

Referring to FIG. 7, the golf club 10 is similar to the flat sole club shown in FIG. 1, but includes a bottom crescent surface 11. Thus, the cross-sectional view of this club 10 is substantially the same as FIG. 6 and all of the discussion about the first embodiment shown in FIGS. 4–6, regarding the front border 19, the rear border 18 and the positioning of the primary point PP apply to this embodiment.

The present invention is also directed to a set of irons and preferably wedge-type irons having lofts greater than 45°. In a preferred set, as shown in FIGS. 8–11 and as set forth in Table I, each of the wedges has sole 15 configured such as that shown in FIGS. 4–7. Each of the club heads in this set has a primary point PP that is located at or substantially below the intersection of the plane through the leading edge LEP and line perpendicular to the front face that is 0.55 inches from the leading edge or at the $4^{th}$ score line. Further, each of the wedge-type irons has a maximum width of the bottom crescent surface $d_1$ that is substantially the same and that is greater than about 0.3 inches. Also, the maximum width of the bottom crescent surface $d_1$ is greater than 0.2 times the total sole width $d_2$. In this embodiment, the leading edge height LEH is substantially constant through the set and is less than 0.25 inches. The bounce angle Θ for each of the clubs is between 12° and 15° and increases through the set with an increase in iron loft. Finally, the perpendicular distance between the trailing edge and the front face $d_3$ is less than 1.0 inches for each of the irons in the set and preferably decreases with the iron loft through the set. In each of the irons in this set, the line perpendicular to the face at 0.55 inches from the leading edge or at the $4^{th}$ score line extends through the bottom crescent surface 17.

TABLE I

| FIG. | Loft | $d_1$ | $d_2$ | $d_3$ | Θ | LEH |
|---|---|---|---|---|---|---|
| 8 | 54° | .31" | 1.04" | .80" | 13.2° | .22" |
| 9 | 56° | .31" | 1.03" | .78" | 13.3° | .22" |
| 10 | 58° | .31" | 1.01" | .75" | 13.3° | .22" |
| 11 | 60° | .31" | 1.00" | .70" | 14.0° | .22" |

Referring to Table II and FIGS. 12–15, disclose another preferred set of wedge irons includes a trailing edge TE, each wedge located at a distance $d_3$ that is approximately 0.7 inches perpendicularly from the leading edge. In this set, the maximum width $d_1$ of the bottom crescent surface 17 is substantially constant throughout the set and is greater than about 0.25 inches. Moreover, the maximum width of the bottom crescent surface $d_1$ is greater than 0.3 times the maximum width of the sole $d_2$. In this set, the bounce angle Θ decrease with the loft of the club and preferably ranges between about 13° and about 20°. As with the previous set, the leading edge height LEH is substantially constant and is less than about 0.25 inches.

TABLE II

| FIG. | Loft | $d_1$ | $d_2$ | $d_3$ | Θ | LEH |
|---|---|---|---|---|---|---|
| 12 | 54° | .31" | .87" | .7" | 18.2° | .22" |
| 13 | 56° | .31" | .90" | .7" | 17.3° | .22" |
| 14 | 58° | .31" | .94" | .7" | 16.0° | .22" |
| 15 | 60° | .31" | .99" | .7" | 14.0° | .22" |

Referring now to Table III and FIGS. 16–19, another preferred set of wedge irons have a maximum width $d_1$ of the bottom crescent surface 17 that increases with the loft of each club. The maximum width $d_1$ of the bottom crescent surface 17 of each club is greater than 0.3 inches and is preferably between about 0.3 and 0.5 inches. Moreover, the maximum width $d_1$ of the bottom crescent surface 17 is approximately ½ of the distance between the front face and the trailing edge $d_3$ or greater. The distance between the front face and the trailing edge $d_3$ is substantially constant. The bounce angle Θ is preferably between 12° and 15° and the leading edge height LEH is substantially constant at a height of less than about 0.25 inches. Preferably, the maximum width $d_1$ of the bottom crescent surface 17 is greater than the leading edge height LEH.

TABLE III

| FIG. | Loft | $d_1$ | $d_3$ | Θ | LEH |
|---|---|---|---|---|---|
| 16 | 54° | .33" | .75" | 14.0° | .22" |
| 17 | 56° | .36" | .75" | 13.2° | .22" |
| 18 | 58° | .38" | .75" | 13.3° | .22" |
| 19 | 60° | .41" | .75" | 13.0° | .22" |

Referring now to Table IV and FIGS. 20–23, another preferred set of wedge irons have a substantially constant bounce angle Θ. Preferably, the bounce angle Θ is between about 12° and 20°. More preferably, the bounce angle Θ is between about 12° and 15°. Also, it is preferred that the distance from the front face to the trailing edge $d_3$ remain substantially constant and between about 0.5 inches and 1 inch. Most preferably, the bottom crescent surface maximum width $d_1$ is changed and the leading edge height LEH is changed to maintain a constant bounce angle Θ and distance from the front face to the trailing edge $d_3$. However, it is preferred that the leading edge height LEH is less than about 0.25 inches for each club and that the bottom crescent surface maximum width $d_1$ is greater than about 0.25 inches.

TABLE IV

| FIG. | Loft | $d_1$ | $d_3$ | Θ | LEH |
|---|---|---|---|---|---|
| 20 | 54° | .33" | .75" | 14.0° | .22" |
| 21 | 56° | .33" | .75" | 14.0° | .23" |
| 22 | 58° | .36" | .75" | 14.0° | .24" |
| 23 | 60° | .40" | .75" | 14.0° | .24" |

It will be understood that each of the clubs disclosed in Tables I–IV and FIGS. 8–28 above are representative of individual clubs according to the present invention and that the clubs could be combined with other clubs to form additional sets. Based on the teachings herein and a player's preference, one of ordinary skill can create many different clubs or sets that are within the scope of the invention. Thus, the above disclosure of sets is merely meant to provide examples of preferred embodiments and not limit the scope of the claims below. Furthermore, while each of the sets above include four irons, it is intended that the word set mean two or more clubs. Also, the sets discussed above are for wedge-type irons, however, it is clear that the teachings herein can be applied to a full set of irons such as those taught in U.S. Pat. No. 5,549,296.

Figure 24:
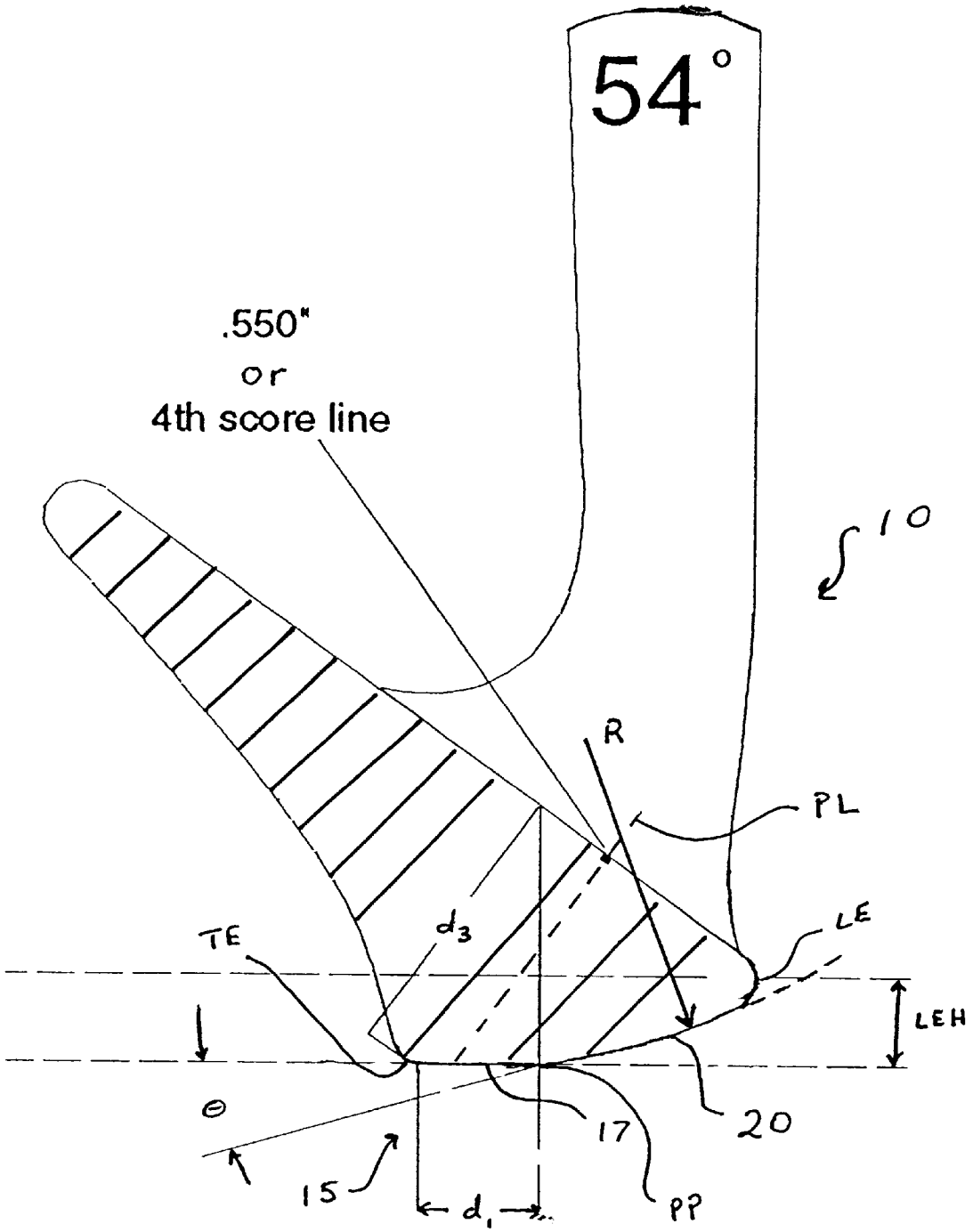
FIG. 24 is a blown up cross-sectional view of another embodiment of a golf club having a sole according to the present invention.
Figure 25:
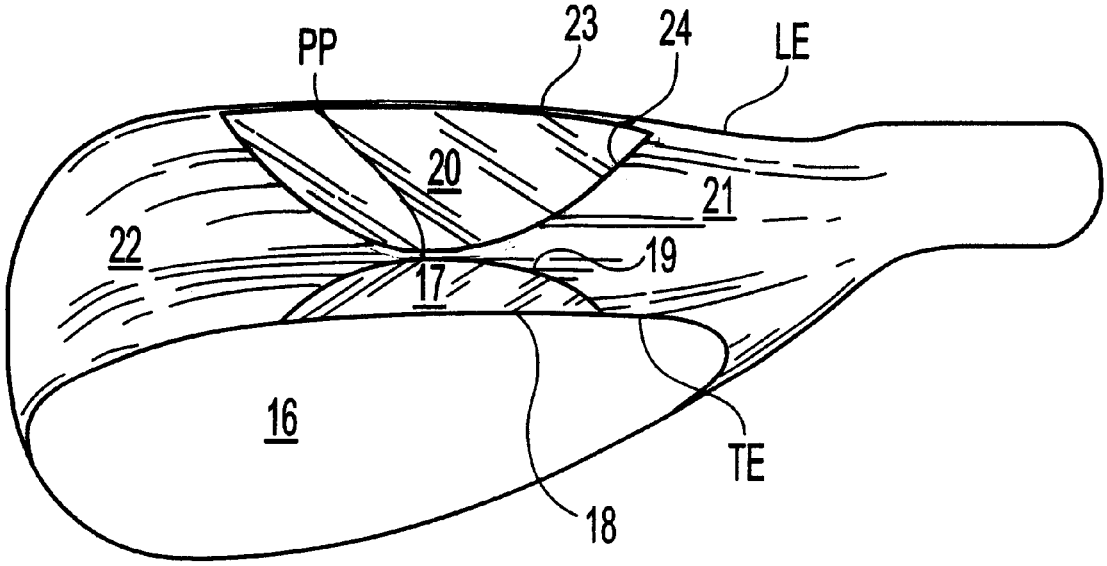
FIG. 25 is a bottom view of another embodiment of a golf club.

Referring to FIG. 24, another preferred embodiment of the invention can include a camber positive bounce surface 20 that has a convex curvature radius R. Most preferably, the radius of the curvature R of the positive bounce surface 20 is greater than about 1 inch and, more preferably is between about 1.5 inches and 2.5 inches. The radius R of the curvature of the positive bounce surface of the club shown in FIG. 24 is about 2 inches. The radius of the curvature R is also preferably more than twice the distance between the front face and the trailing edge $d_3$ (as shown in FIGS. 8–23) and more than four times the maximum width of the bottom crescent surface $d_1$. Each of the club heads set forth above can include this camber positive bounce surface 20 as well as a concave curvature of similar radius.

We claim:

1. A golf club having a sole comprising a leading edge and a positive crescent-shaped bounce surface between the leading edge and a bottom surface that is substantially planar with the ground when addressed by a player, the bottom surface being crescent shaped with a back border being substantially straight and being substantially adjacent to a trailing edge of the sole and a front border extending toward but not reaching the positive bounce surface.

2. The golf club of claim 1, wherein the bottom surface includes a furthest forward point positioned near a middle of the sole between a toe and a heel of the club.

3. The golf club of claim 2, wherein the distance between the forward most point and the back border is greater than about 0.25 inch.

4. The golf club of claim 1, wherein the bottom crescent surface is a substantially flat surface having an angle with the horizontal plane of between −4° and +4° when the shaft is in the vertical plane.

5. The golf club of claim 1, wherein the bottom crescent surface is a substantially flat surface having an angle with the horizontal plane of between −2° and +2° when the shaft is in the vertical plane.

6. A golf club having a sole comprising a bottom surface that is substantially planar with the ground when addressed by a player, the bottom surface being crescent-shaped with a back border being substantially straight and being substantially adjacent to a trailing edge of the sole and a front border extending toward the leading edge of the club and a positive bounce crescent surface positioned between the bottom crescent surface and a leading edge of the sole and heel and toe sole surfaces.

7. The golf club of claim 6, wherein the positive bounce crescent surface is a crescent-shaped surface adjacent to the leading edge of the sole.

8. The golf club of claim 7 wherein the positive bounce crescent surface is a substantially planar surface that is angled from the ground by a positive bounce angle.

9. The golf club of claim 8, wherein the positive bounce angle is between 6° and 3°.

10. The golf club of claim 7, wherein the positive bounce crescent surface has two borders, a front border located approximate the leading edge of the sole and a rear border separating the crescent surface from the other surfaces.

11. The golf club of claim 10, wherein the front border is substantially straight and parallel to the leading edge of the sole and the rear border is curved such that the widest point of the positive bounce crescent surface is near the middle of the sole between the toe and heel.

12. The golf club of claim 10, wherein a furthest forward point of the bottom crescent surface and a furthest back point of the positive bounce crescent surface are substantially adjacent to form a primary point.

13. The golf club of claim 10, wherein a line perpendicular to the face at 0.55 inches from the leading edge extends through the bottom crescent surface.

14. A set of golf clubs having a sole comprising a bottom surface that is substantially planar with the ground when addressed by a player, the bottom surface being crescent shaped with a back border being substantially straight and being substantially adjacent to a trailing edge of the sole and a front border extending toward the leading edge of the club and a positive bounce crescent surface positioned between the bottom crescent surface and a leading edge of the sole and heel and toe surfaces.

15. The set of golf clubs of claim 14, wherein the set is comprised of clubs having lofts greater than 46°.

16. The set of golf clubs of claim 14, wherein each of the bottom crescent surfaces has a maximum width that is greater than about 0.3 inch.

17. The set of golf clubs of claim 14, wherein each of the bottom crescent surfaces has a maximum width that is substantially the same as the others.

18. The set of golf clubs of claim 14, wherein each of the bottom crescent surfaces has a maximum width that is greater than 0.2 times a total sole width.

19. The set of golf clubs of claim 14, wherein each of the clubs has a leading edge height that is substantially constant through the set.

20. The set of golf clubs of claim 14, wherein each of the clubs has a leading edge height that is less than 0.25 inch.

21. The set of golf clubs of claim 14, wherein each of the back borders is located approximately 0.7 inch perpendicularly from the leading edge.

22. The set of golf clubs of claim 14, wherein each of the clubs has a maximum width of the bottom crescent surface that increases with the loft of each club through the set.

23. The set of golf clubs of claim 14, wherein each of the clubs has a maximum width of the bottom crescent surface that is approximately ½ of a distance between the front face and the trailing edge or greater.

24. The set of golf clubs of claim 23, wherein the distance between the front face and the trailing edge is substantially constant through the set.

25. The set of golf clubs of claim 14, wherein each of the clubs has a maximum width of the bottom crescent surface that is greater than a leading edge height for each club.

26. The set of golf clubs of claim 14, wherein each of the clubs has a distance measured perpendicularly from the front face to the trailing edge that is substantially constant through the set.

27. The set of golf clubs of claim 26, wherein distance measured perpendicularly from the front face to the trailing edge is between about 0.5 inch and 1 inch.

28. A golf club having a sole comprising a crescent-shaped positive bounce surface and a bottom surface that is substantially planar with the ground when addressed by a player, the bottom surface being crescent-shaped with a back border being substantially straight and being substantially adjacent to a trailing edge of the sole and a front border extending toward the leading edge of the club wherein the club has a loft of greater than about 45° and a primary point located at a position that is vertically below an intersection of a plane that extends from the leading edge and a perpendicular line through the face approximately 0.55 inch from the leading edge in the middle of the club between the heel and toe, the positive bounce surface being between the leading edge and the bottom surface.

29. A set of golf clubs having a sole comprising a bottom surface that is substantially planar with the ground when addressed by a player, the bottom surface being crescent-shaped with a back border being substantially straight and being substantially adjacent to a trailing edge of the sole and a front border extending toward the leading edge of the club, wherein each of the golf clubs has a primary point being the most forward point on the front border that is located substantially below an intersection of a horizontal plane through the leading edge and a line perpendicular to the front face approximately 0.55 inch from the leading edge.

30. A set of golf clubs having a sole comprising a bottom surface is substantially planar with the ground when addressed by a player, the bottom surface being crescent-shaped with a back border being substantially straight and being substantially adjacent to a trailing edge of the sole and a front border extending toward the leading edge of the club wherein each of the golf clubs has a primary point being the most forward point on the front border that is located substantially below an intersection of a horizontal plane through the leading edge and a line perpendicular to the front face at a $4^{th}$ score line thereon.

31. A set of golf clubs having a sole comprising a bottom surface that is substantially planar with the ground when addressed by a player, the bottom surface being crescent-shaped with a back border being substantially straight and being substantially adjacent to a trailing edge of the sole and a front border extending toward the leading edge of the club, wherein each of the clubs has a crescent-shaped bounce surface between the bottom surface and the leading edge and having a bounce angle between about 12° and 15°.

32. A set of golf clubs having a sole comprising a bottom surface that is substantially planar with the ground when addressed by a player, the bottom surface being crescent-shaped with a back border being substantially straight and being substantially adjacent to a trailing edge of the sole and a front border extending toward the leading edge of the club, wherein each of the clubs has a crescent-shaped bounce surface between the bottom surface and the leading edge and having a bounce angle that increases through the set with an increase in iron loft.

33. A set of golf clubs having a sole comprising a bottom surface that is substantially planar with the ground when addressed by a player, the bottom surface being crescent-shaped with a back border being substantially straight and being substantially adjacent to a trailing edge of the sole and a front border extending toward the leading edge of the club, wherein each of the clubs is configured such that a line perpendicular to the face at 0.55 inch from the leading edge extends through the bottom crescent surface 17.

34. A set of golf clubs having a sole comprising a bottom surface that is substantially planar with the ground when addressed by a player, the bottom surface being crescent-shaped with a back border being substantially straight and being substantially adjacent to a trailing edge of the sole and a front border extending toward the leading edge of the club, wherein each of the clubs has a crescent-shaped bounce surface between the bottom surface and the leading edge and having a bounce angle that decreases with the loft of the club through the set.

35. A set of golf clubs having a sole comprising a bottom surface that is substantially planar with the ground when addressed by a player, the bottom surface being crescent-shaped with a back border being substantially straight and being substantially adjacent to a trailing edge of the sole and a front border extending toward the leading edge of the club, wherein each of the clubs has a crescent-shaped bounce surface between the bottom surface and the leading edge and having a substantially constant bounce angle.

* * * * *